US007870980B2

(12) United States Patent
Wilson et al.

(10) Patent No.: US 7,870,980 B2
(45) Date of Patent: Jan. 18, 2011

(54) NON-DRIP SPOUT CLOSURE

(75) Inventors: Tracie Lynn Clemons Wilson, Westminster, MD (US); Steven Gift, Lititz, PA (US)

(73) Assignee: McCormick & Company, Incorporated, Sparks, MD (US)

( * ) Notice: Subject to any disclaimer, the term of this patent is extended or adjusted under 35 U.S.C. 154(b) by 441 days.

(21) Appl. No.: 11/943,256

(22) Filed: Nov. 20, 2007

(65) Prior Publication Data

US 2009/0134188 A1 May 28, 2009

Related U.S. Application Data

(60) Provisional application No. 60/866,511, filed on Nov. 20, 2006.

(51) Int. Cl.
*B65D 5/72* (2006.01)

(52) U.S. Cl. ..... 222/571; 222/1; 222/546; 222/556; 222/566; 222/568; 215/235; 215/237; 220/836; 220/837

(58) Field of Classification Search ..... 222/571, 222/556, 546, 566, 567–568, 547, 1; 215/235–237, 215/329; 220/836–837
See application file for complete search history.

(56) References Cited

U.S. PATENT DOCUMENTS

| | | | | |
|---|---|---|---|---|
| 2,704,170 | A | 6/1953 | Ray | |
| 3,208,650 | A | 9/1965 | La Ham | |
| 3,307,752 | A | 3/1967 | Anderson | |
| 3,549,062 | A | 12/1970 | Teetor | |
| 4,638,916 | A * | 1/1987 | Beck et al. | 215/235 |
| 4,696,408 | A | 9/1987 | Dubach | |
| D319,981 | S | 9/1991 | Sledge | |
| 5,141,138 | A | 8/1992 | Odet et al. | |
| 5,169,040 | A | 12/1992 | Wiley | |
| D334,538 | S | 4/1993 | Bolen et al. | |
| 5,407,087 | A * | 4/1995 | Giblin et al. | 215/260 |
| D399,744 | S | 10/1998 | Gross | |
| 5,850,953 | A | 12/1998 | Dallas, Jr. | |
| 5,875,942 | A | 3/1999 | Ohmi et al. | |
| 5,934,496 | A | 8/1999 | Mogard et al. | |
| 6,116,477 | A | 9/2000 | Kreiseder et al. | |
| 6,367,670 | B1 | 4/2002 | Warner et al. | |

(Continued)

FOREIGN PATENT DOCUMENTS

| | | |
|---|---|---|
| JP | 1-254566 | 10/1989 |

(Continued)

OTHER PUBLICATIONS

U.S. Appl. No. 29/250,547, filed Nov. 20, 2006, Wilson.

(Continued)

*Primary Examiner*—Frederick C. Nicolas
(74) *Attorney, Agent, or Firm*—Oblon, Spivak, McClelland, Maier & Neustadt, L.L.P.

(57) ABSTRACT

A closure includes a flip-top member including an elongated flange, a base member including a curved flange extending from the base member, and a hinge to connect the flip-top member and the base member. The base member has an opening therein. A portion of the elongated member is configured to reside within the opening when the closure is in a closed position.

23 Claims, 12 Drawing Sheets

U.S. PATENT DOCUMENTS

| | | | | |
|---|---|---|---|---|
| 6,382,476 | B1 * | 5/2002 | Randall et al. | 222/545 |
| D476,892 | S | 7/2003 | Martin et al. | |
| D530,202 | S | 10/2006 | Herald et al. | |
| 2004/0026465 | A1 | 2/2004 | Klopfer | |
| 2005/0145655 | A1 | 7/2005 | Giblin et al. | |

FOREIGN PATENT DOCUMENTS

| | | |
|---|---|---|
| JP | 01-254566 | 10/1989 |

OTHER PUBLICATIONS

U.S. Appl. No. 29/322,200, filed Jul. 30, 2008, Wilson.
U.S. Appl. No. 29/322,205, filed Jul. 30, 2008, Wilson.
U.S. Appl. No. 29/322,206, filed Jul. 30, 2008, Wilson.
U.S. Appl. No. 29/322,212, filed Jul. 30, 2008, Wilson.
U.S. Appl. No. 29/322,215, filed Jul. 30, 2008, Wilson.
U.S. Appl. No. 29/324,285, filed Sep. 10, 2008, Wilson et al.
Canadian Office Action dated Aug. 19, 2010, regarding Canadian Application No. 2,611,309 which corresponds to U.S. Appl. No. 11/943,256.

* cited by examiner

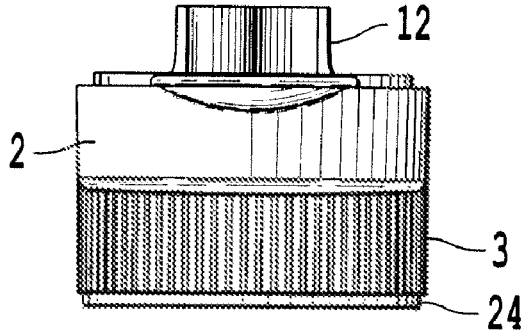
*Fig. 12*
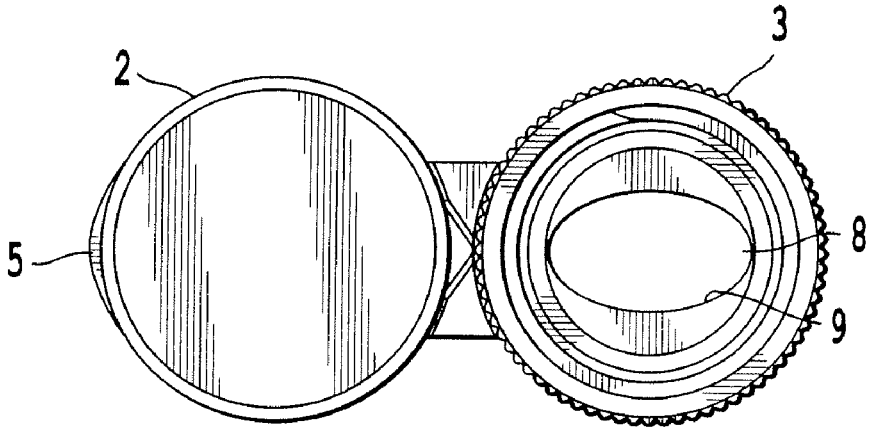
*Fig. B*

NON-DRIP SPOUT CLOSURE

CROSS-REFERENCE TO RELATED APPLICATIONS

This application claims the benefit of the earlier filing date of U.S. Provisional Application No. 60/866,511, filed Nov. 20, 2006, entitled "Non-Drip Spout," the entirety of which is incorporated herein by reference.

BACKGROUND

A non-drip spout is provided, more specifically, the present specification describes a non-drip spout for a container which contains fluids or liquids but which is also capable of holding powders or other materials which are capable of being poured through a spout.

The pouring spouts of liquid containers are normally intended to provide a smooth flow of liquid through the spout and also to minimize dripping from the spout at the end of the pouring operation. The drips that form on a spout after pouring are undesirable for numerous reasons including wetting and staining of the exterior of the spout and the container, and often result in wetting or staining of the surface on which the container rests.

Conventional spout closures tend to improperly dispense liquid food products when poured from them so as to create a build up of excess dried material around the spout subsequent to pouring of a liquid food product. As a result, the liquid product tends to drip from an orifice of the spout onto the closure and also potentially drip down the bottle or container on which the closure is mounted. In the event the liquid food product is dripped onto the closure, the flip-top lid portion provided can become stuck to the base by the product upon becoming dried and thus become difficult to open. In addition, if the product is permitted to drip down the bottle, it can become difficult for a consumer to handle the bottle.

Numerous attempts have been made to provide a dripless spout, and it has been generally realized that providing the spout with a thin or sharply cut off lip may enhance the "dripless" characteristics of the spout. This is recognized in U.S. Pat. No. 2,704,170 to Ray, which describes a teapot formed of ceramic material or glass. The spout opening of the teapot is bordered on the sides and bottom by a spout which extends outwardly and curves downwardly. The spout decreases in cross-section towards its extremity and terminates in a relatively sharply defined U-shaped lip undercut or relieved at its backside. U.S. Pat. No. 3,549,062 to Teetor discloses a pouring vessel provided with a droplet retaining structure which retains the droplet normally formed when pouring on a drip retaining lip. The lip is located at the outside of the sidewall at the front of the vessel and slightly below a pouring portion of the sidewall. The lip defines a small recess or pocket between the lip and a pouring portion of the sidewall. The front portion of the lip has a sharp upper edge with a generally vertical outer face and a very restricted horizontal surface. The lip defines a recess of restricted volume whereby the retaining forces, such as surface tension, and cohesive and adhesive forces over the liquid, temporarily retain the last drop of liquid in the recess. This drop then flows through a vertical slot in the pouring portion of the vessel and runs back into the vessel.

Also known is a dripless spout, as disclosed in U.S. Pat. No. 5,169,040 to Wiley, which discloses a dripless spout which can be formed integrally with a liquid container or can be adapted for attachment to a liquid container. In this conventional spout, a dripless spout includes a service having a lid over which a liquid to be poured may flow, and a channel is formed in the surface which extends over at least a portion of the surface of a lip. At the end of a pouring operation, any droplets of liquid remaining on the surface occupy the channel and are held therein. The spout is formed of a relatively thin material and may be provided in the form of a spring clip for fitting to a liquid container or may be formed integrally with the liquid container. As can be appreciated from a review of this invention, the lid does not utilize a flip-top cap portion and thus remains open subsequent to a pouring operation.

SUMMARY

An object of the present invention is to provide a non-drip spout with a functional closure that can easily dispense liquid food products, for example, without creating a mess on the closure or on the bottle/container on which the closure is mounted.

The non-drip spout is shaped in such a manner as to catch and hold back any remaining drops of liquid product after the product has been dispensed. The size of the orifice permits a smooth and consistent pouring so as to inhibit glugging of the liquid during dispensing which, in turn, could affect the flow of the fluid and cause the liquid to drip over an edge of the spout due to the ebb and flow of fluid from the spout. These fluctuations in flow are to be avoided if, for example, a measured amount of fluid is to be dispensed.

The closure includes a one-piece system with a hinged lid or flip-top portion. Thus, the closure does not require a separate insert or an adjoining piece such as a lid that is detachable from the base of the closure.

The spout of the one piece flip-top closure functions as a non-drip feature when extract type products are dispensed. The external and internal vertical angle of the spout, the spout curvature shape, and the shape of the upper lip section allows for the non-drip pour feature of the spout. The upper lip section extends outward and horizontally from the spout edge. The radius at which the upper lip meets the spout edge and the length of the lip is important for the non-drip feature to properly function. The shape and size of the orifice allows for a smooth, non-glugging pouring operation which also contributes to the product flow supporting a non-drip pouring function.

It is to be understood that both the foregoing general description and the following detailed description are exemplary, but are not restrictive, of the inventions described herein.

BRIEF DESCRIPTION OF THE SEVERAL VIEWS OF THE DRAWINGS

A more complete appreciation of the inventions and many of the attendant advantages thereof will be readily obtained as the same becomes better understood by reference to the following detailed description when considered in connection with the accompanying drawings. However, the accompanying drawings and their exemplary depictions do not in any way limit the scope of the inventions embraced by this specification. The scope of the inventions embraced by the specification and drawings are defined by the words of the accompanying claims.

A more complete understanding of the inventions can be drawn from attached FIGS. 1-22 wherein:

FIG. 12 is a rear elevational view of the non-drip spout shown in FIG. 8;

FIG. 13 is a bottom plan view of the non-drip spout shown in FIG. 8;

DETAILED DESCRIPTION

Figure 1:
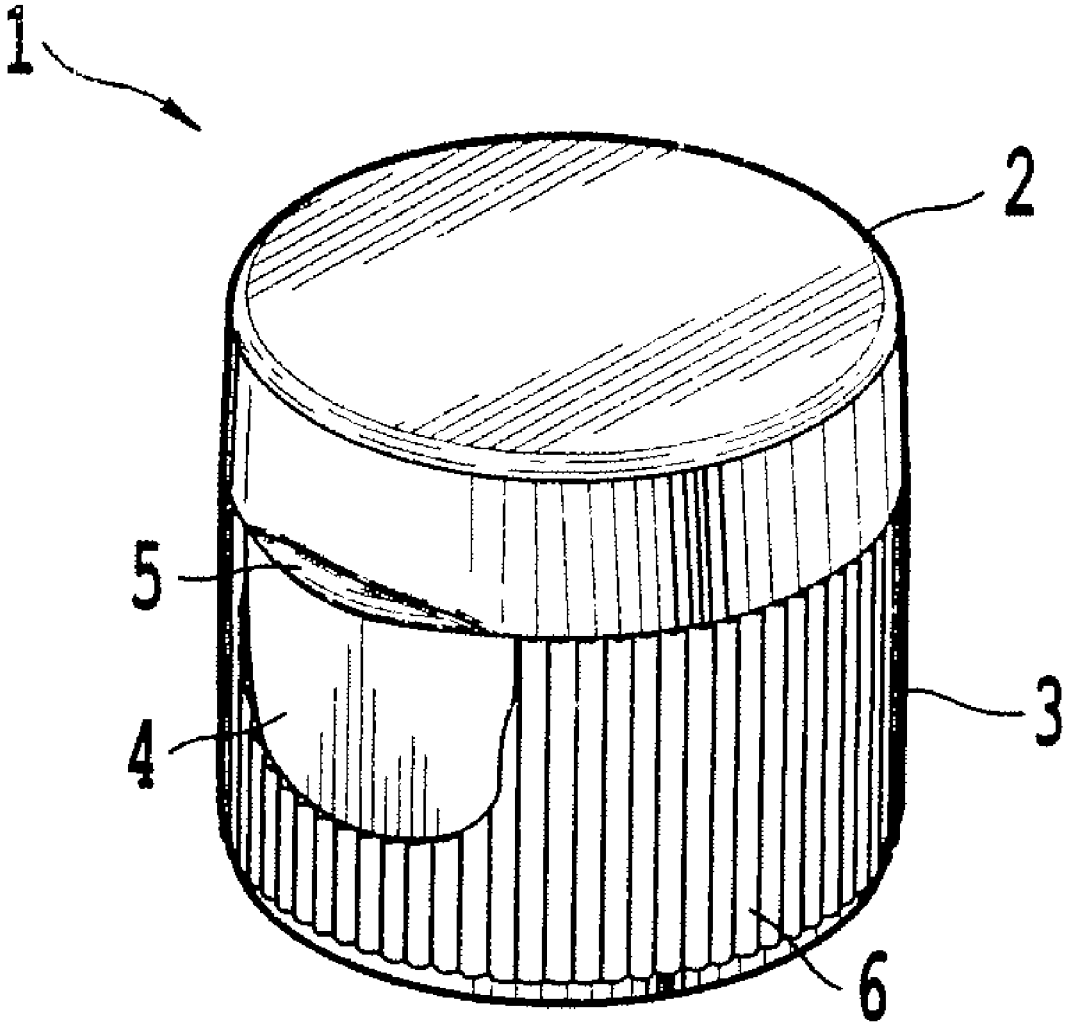
FIG. 1 is a top and right front perspective view of an exemplary embodiment of a non-drip spout.
Figure 2:
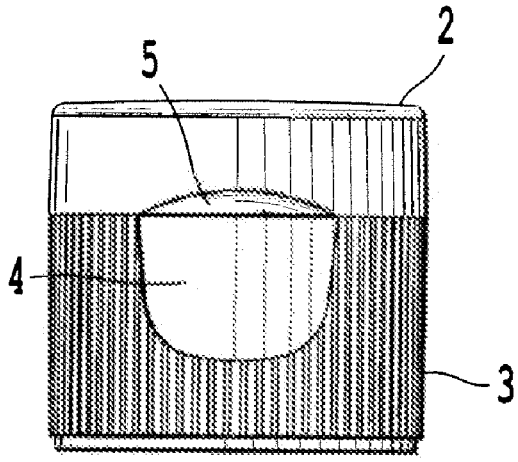
FIG. 2 is a front elevational view of the non-drip spout shown in FIG. 1.
Figure 3:
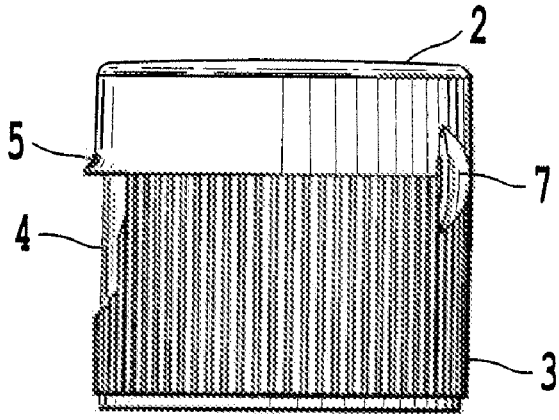
FIG. 3 is a right side elevational view of the non-drip spout shown in FIG. 1, the left side elevational view being a mirror image of the side view shown.
Figure 4:
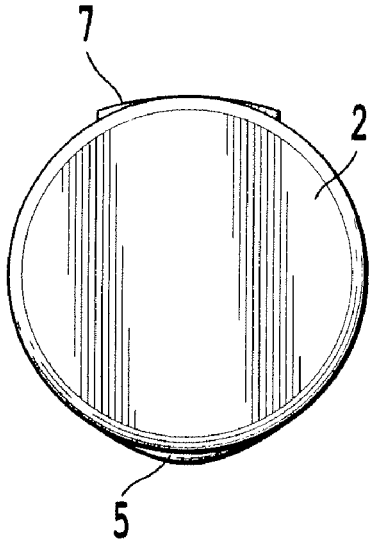
FIG. 4 is a top plan view of the non-drip spout shown in FIG. 1.
Figure 5:
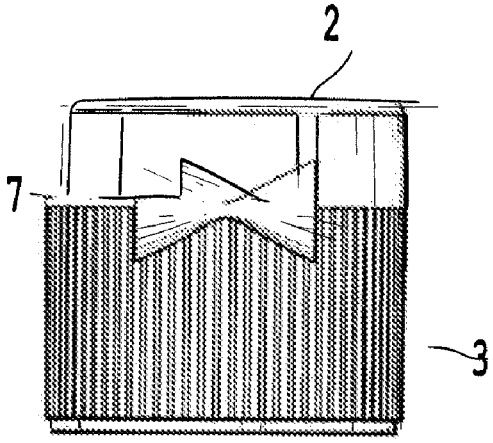
FIG. 5 is a rear elevational view of the non-drip spout shown in FIG. 1.

Certain terminology is used in the following description for convenience only and is not limiting. Unless otherwise noted, any directional terms such as "above," "below," and "outside" refer to directions with respect to the closure in accordance with the present invention, when the closure is in an upright position. The terminology includes the words noted above as well as derivatives thereof and additional words of similar import. Referring now to the drawings, wherein like reference numerals designate identical or corresponding parts throughout the several views.

Figure 6:
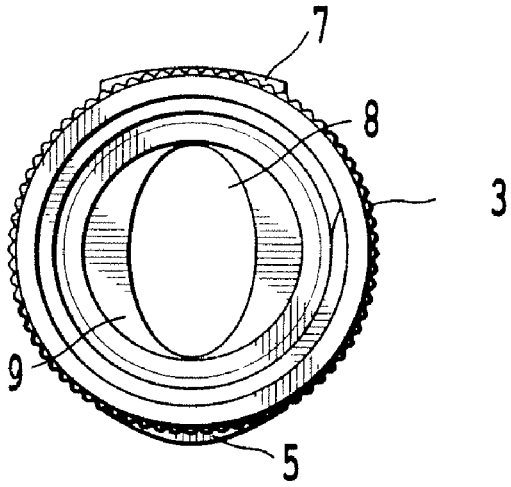
FIG. 6 is a bottom plan view of the non-drip spout shown in FIG. 1.
Figure 7:
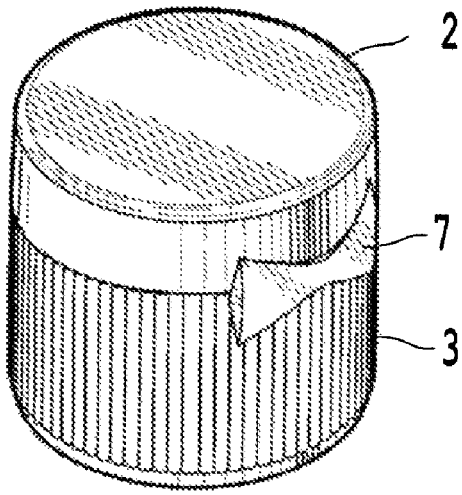
FIG. 7 is a top and right rear perspective view of the non-drip spout shown in FIG. 1.

As shown in FIGS. 1-7, the non-drip spout is in the form of a closure 1 having a flip-top portion 2 and base 3. For opening of the flip-top portion 2, a tab 5 is provided along one side portion of the flip-top portion 2 in proximity with a planar recess 4 formed in the base 3. The base 3 has a threaded portion for being screwed onto the top of a bottle or container having threads that cooperate therewith. The base 3 has a ribbed side portion 6 for ease in screwing or unscrewing of the closure 1 from the bottle or container. An integrally molded hinge member 7 is provided at the rear portion of the closure 1 and serves to interconnect the flip-top portion 2 with the base 3 in a flexible manner so as to permit opening of the flip-top portion 2. As shown in FIG. 6, an elongated opening 8, which can be substantially elliptically shaped, is provided. The major axis of the elongated opening 8 extends in a direction from the hinge member 7 to the tab 5. This elongation forms an elongated opening 8 having an inner edge 9 with a cross-sectional area of from substantially one-eighth to one-third of the cross-sectional area of the base 3. The opening 8 of this size permits smooth pouring and does not cause a glugging action or an interruption of flow of fluid from the container when passing through the non-drip spout.

As shown, the base 3, the flip-top portion 2, and the hinge member 7 are integrally molded. The closure 1 can be made from a single mold, for example a side action mold, resulting in efficient manufacture thereof as a unitary piece. The unitary piece can be made of polypropylene, for example, a copolymer or a homopolymer.

Figure 8:
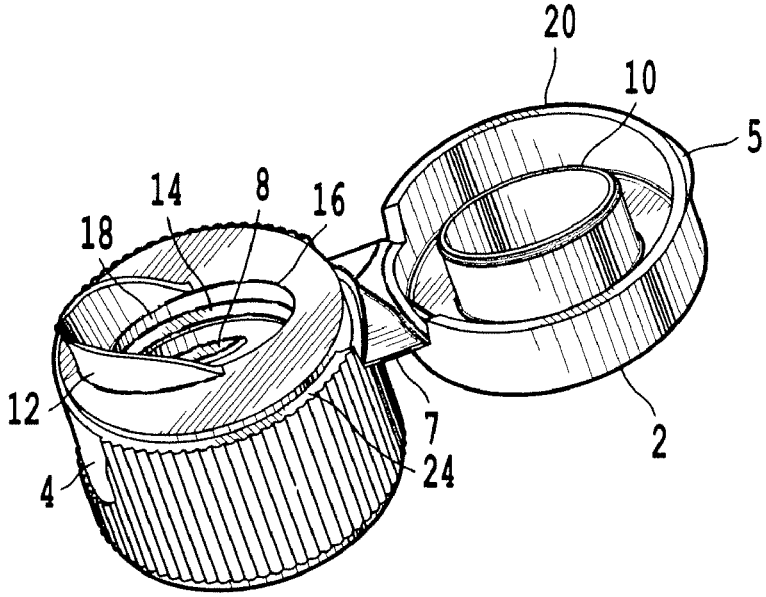
FIG. 8 is a top and right front perspective view of another exemplary embodiment of a non-drip spout shown in an open condition.
Figure 9:
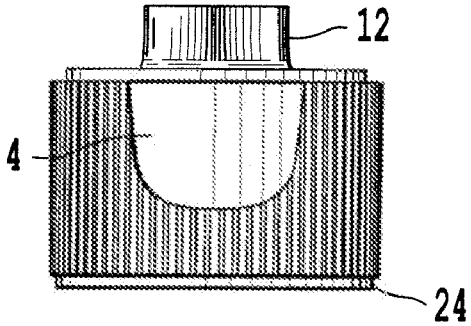
FIG. 9 is a front elevational view of the non-drip spout shown in FIG. 8.
Figure 10:
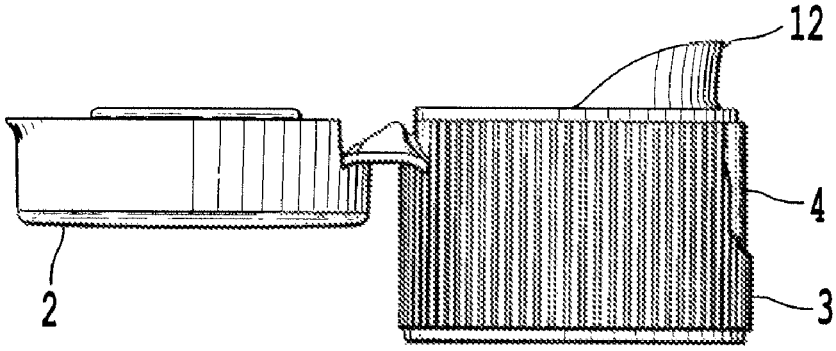
FIG. 10 is a left side elevational view of the non-drip spout shown in FIG. 8, the right side elevational view being a mirror image of the side view shown.
Figure 11:
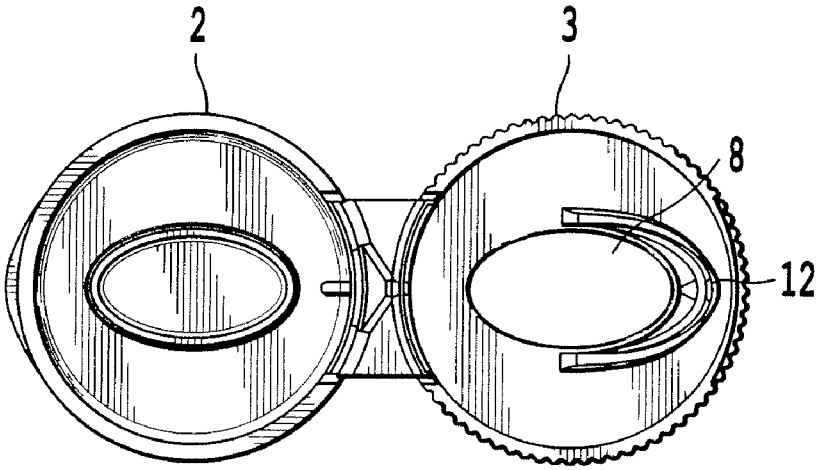
FIG. 11 is a top plan view of the non-drip spout shown in FIG. 8.

As shown in FIGS. 8-13, the closure 1 also includes an uprightly-extending curved flange 12 and an elliptically-shaped elongated flange 10 provided on the base 3 and flip-top member 2, respectively. The base 3 is provided with a recessed surface 14 which extends down to a substantially horizontal edge 18 which cooperates with the flange 10 upon closing the closure 1. Flip-top portion 2 is also provided with a rim 20 which mates with a recessed rim 24 provided in the upper portion of the base 3 as illustrated in FIG. 8. An opening 16 is also of sufficient diameter so as to permit passage of the flange 10 therethrough for engagement with the recessed surface 14 as mentioned above.

Figure 14:
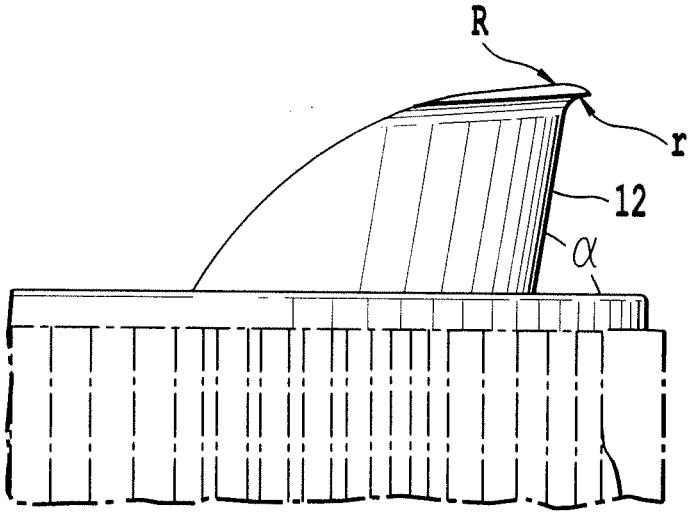
FIG. 14 is a left side elevational view of a portion of another exemplary embodiment of a non-drip spout.
Figure 15:
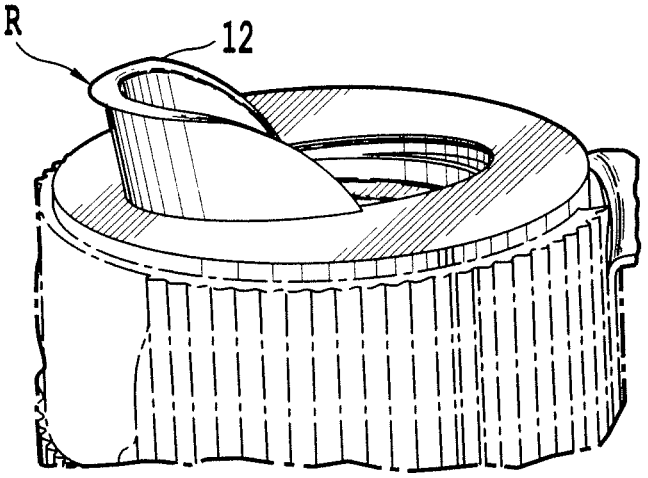
FIG. 15 is a top, front, and right side perspective view of a portion of the non-drip spout shown in FIG. 14.
Figure 16:
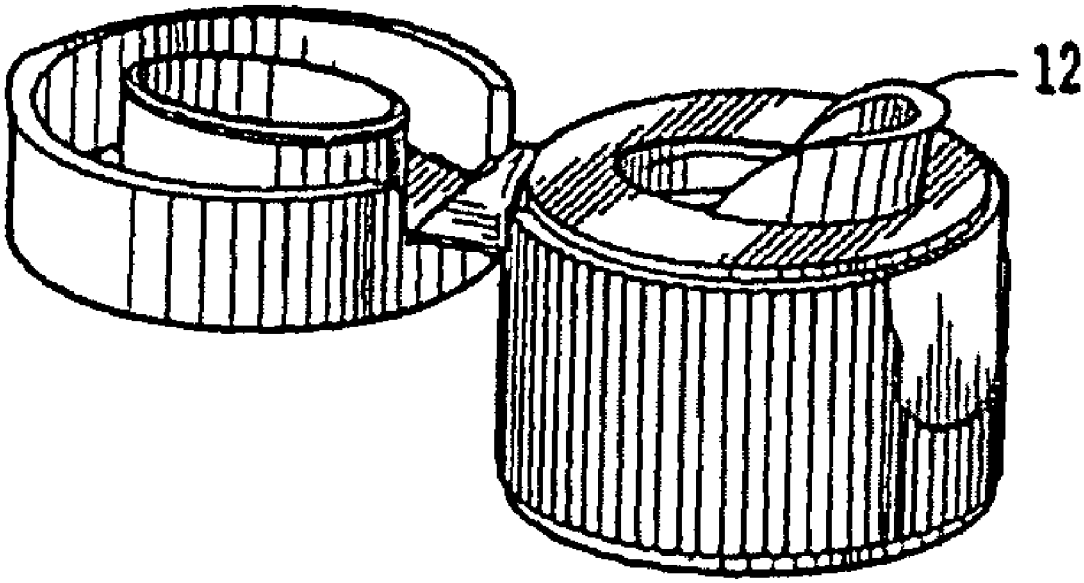
FIG. 16 is a top, front, and left side perspective view of the non-drip spout shown in FIG. 14, the top, front, and right side elevational view being a mirror image of the side view shown.

FIGS. 14-16 illustrate an additional embodiment wherein the curved flange 12 has been modified so as to have an extended end edge portion in the form of a front lip. As shown in FIGS. 14 and 15, the curved flange 12 has a curvature radius R of 0.030"±0.005". The angle of elevation $\alpha$ of the front wall of curved flange 12 with respect to the horizontal top surface of base 3 is preferably 85°±5°. The radius r of the front lip of the curved flange 12 is 0.020"±0.005".

Figure 17:
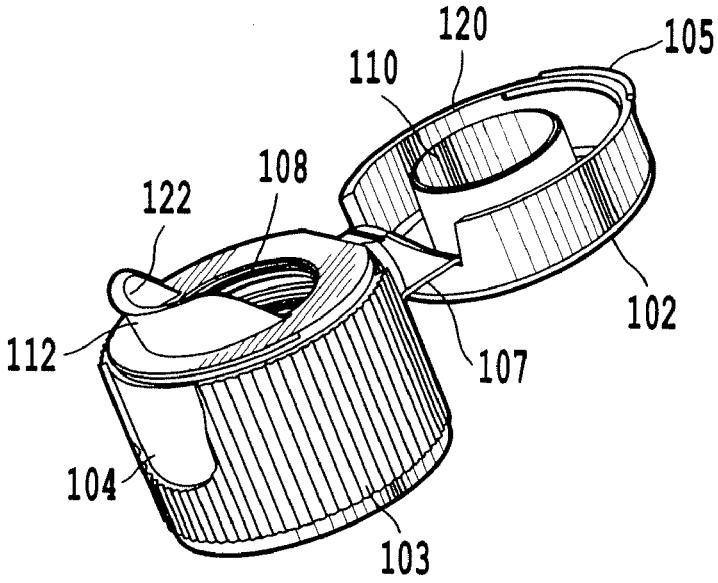
FIG. 17 is a top and right front perspective view of another exemplary embodiment of a non-drip spout shown in an open condition.
Figure 18:
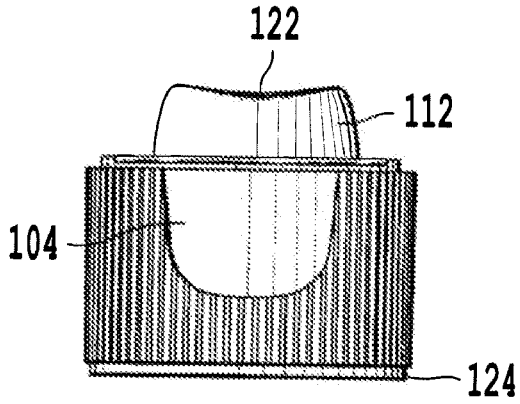
FIG. 18 is a front elevational view of the non-drip spout shown in FIG. 17.
Figure 19:
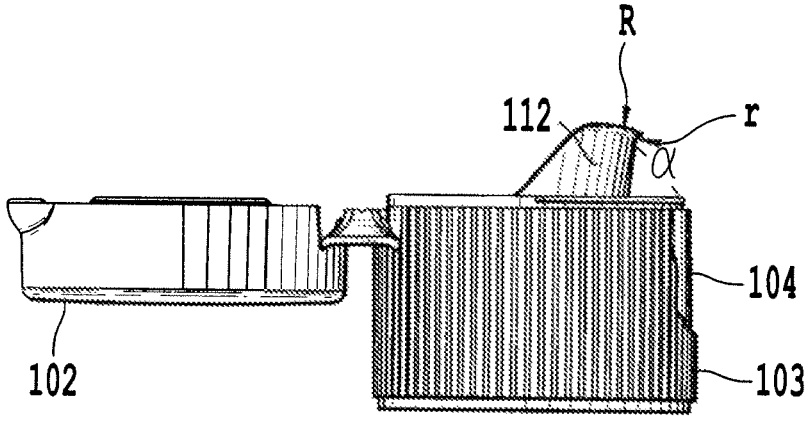
FIG. 19 is a left side elevational view of the non-drip spout shown in FIG. 17, the right side elevational view being a mirror image of the side view shown.

As shown in FIG. 17-22, which illustrates another embodiment, the closure 101 includes an uprightly-extending, substantially circular, curved flange 112 provided on the base 103, which includes a concave shaped upper rim portion 122 as shown in FIG. 18 and a substantially circular-shaped elongated flange 110 provided on the flip-top member 102. The curved flange 112 can have the same curvature radius R, angle of elevation $\alpha$, and radius r as the embodiment of the curved flange 12 described with respect to FIGS. 14-16. The combination of the angle of elevation $\alpha$, the curvature radius R, and the concave shaped upper rim portion 122 particularly contribute to the non-drip property of the closure 101.

Figure 20:
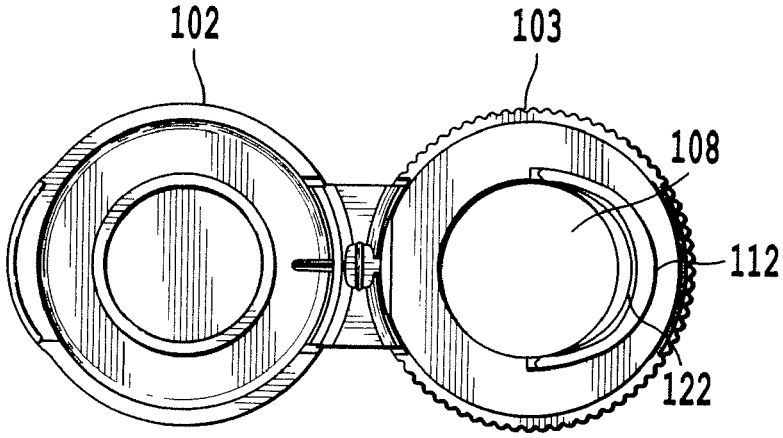
FIG. 20 is a top plan view of the non-drip spout shown in FIG. 17.
Figure 21:
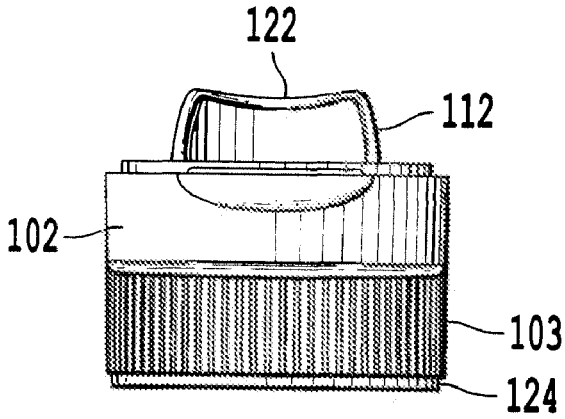
FIG. 21 is a rear elevational view of the non-drip spout shown in FIG. 17.
Figure 22:
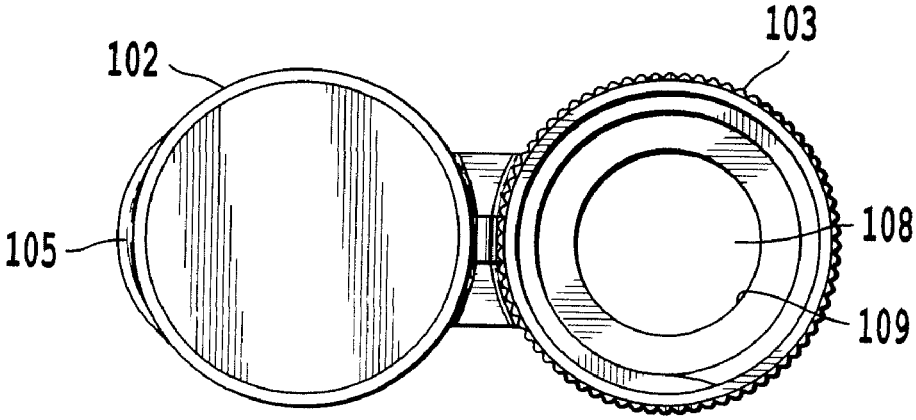
FIG. 22 is a bottom plan view of the non-drip spout shown in FIG. 17.

The base 103 is also provided with a recessed surface 118 which extends down to a substantially horizontal edge 114 which cooperates with the flange 110 to prevent any material from passing through an opening 116 in the base 103 upon closing the flip-top member 102. Flip-top member 102 is also provided with a rim 120 which mates with a recessed rim 124 provided in the upper portion of the base 103 as illustrated in FIG. 17. The arc formed by the curved flange 112, as shown in FIG. 20, is in the range of 120°-180°. The substantially circular opening 116 is provided in the base 103 and is of sufficient diameter to permit passage of the flange 110 therethrough for engagement with a horizontal edge 114. Hinge member 107 is also provided, along with a tab member 105, on the flip-top member 102. A planar recess 104 is provided and a substantially circular opening 108 is formed in the base 103. As shown in FIG. 18, the upper edge of the curved flange 112 is provided with a concave shaped upper rim portion 122 which is approximately 0.025 inches less in height than the lateral edges shown in this view, which corresponds to approximately 15% of the height of the curved flange 112 from the base 103.

The resulting non-drip spout thus is relatively easy to manufacture and provides distinct advantages over conventional spouts.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, define, in part, the scope of the foregoing claim terminology such that no inventive subject matter is dedicated to the public.

The invention claimed is:

1. A closure, comprising:

a flip-top member including an elongated flange;

a base member including a curved flange extending from the base member, the curved flange including an upper edge having a concave center portion and lateral portions surrounding the center portion, the lateral portions extending further away from the base member than the center portion; and a hinge configured to connect the flip-top member and the base member, wherein the base member has an opening therein, and a portion of the elongated member is configured to reside within the opening when the closure is in a closed position.

2. The closure according to claim 1, wherein the curved flange surrounds a portion of the opening of the base member.

3. The closure according to claim 1, wherein the curved flange extends from the base member such that an angle of elevation between the curved flange and a horizontal surface of the base member is from 80 to 90 degrees.

4. The closure according to claim 1, wherein the curved flange has a radius of curvature of from 0.025 to 0.035 inches.

5. The closure according to claim 1, wherein the curved flange has a front lip on an outermost portion of the curved flange, and a radius of curvature of the front lip is from 0.015 to 0.025 inches.

6. The closure according to claim 1, wherein the curved flange extends from the base member such that an angle of elevation between the curved flange and a horizontal surface of the base member is from 80 to 90 degrees, the curved flange has a radius of curvature of from 0.025 to 0.035 inches, the curved flange has a front lip on an outermost portion of the curved flange, and a radius of curvature of the front lip is from 0.015 to 0.025 inches.

7. The closure according to claim 1, wherein the flip-top member includes an outer rim on a perimeter of the flip-top member, the base member includes a recessed rim on a perimeter of the base member, and a portion of the outer rim contacts the base member when the closure is in a closed position.

8. The closure according to claim 1, wherein the opening of the base member is circular, the curved flange forms an arc around the opening of the base member, and an angle of the arc is from 120 to 180 degrees.

9. The closure according to claim 1, wherein the opening of the base member includes an elongated opening from a front to a rear portion of the closure.

10. The closure according to claim 1, wherein the curved flange extends from the base member such that an angle of elevation between the curved flange and a horizontal surface of the base member is less than 90 degrees.)

11. The closure according to claim 1, wherein the lateral portion of the upper edge of the curved flange extends 15% farther away from the base than the concave center portion of the upper edge of the curved flange.

12. A method of forming a closure, comprising:

forming a flip-top member including an elongated flange;

forming a base member having an opening therein and including a curved flange extending from the base member, the curved flange including an upper edge having a concave center portion and lateral portions surrounding the center portion, the lateral portions extending further away from the base member than the center portion; and forming a hinge configured to connect the flip-top member and the base member such that a portion of the elongated member resides within the opening when the closure is in a closed position, wherein the closure is formed as a unitary piece.

13. A bottle, comprising:

a body configured to receive a material therein; and a closure detachably connected to the body, the closure including a flip-top member including an elongated flange, a base member including a curved flange extending from the base member, the curved flange including an upper edge having a concave center portion and lateral portions surrounding the center portion, the lateral portions extending further away from the base member than the center portion, and a hinge configured to connect the flip-top member and the base member, wherein the base member has an opening therein, a portion of the elongated member is configured to reside within the opening when the closure is in a closed position.

14. The bottle according to claim 13, wherein the curved flange surrounds a portion of the opening of the base member.

15. The bottle according to claim 13, wherein the curved flange extends from the base member such that an angle of elevation between the curved flange and a horizontal surface of the base member is from 80 to 90 degrees.

16. The bottle according to claim 13, wherein the curved flange has a radius of curvature of from 0.025 to 0.035 inches.

17. The bottle according to claim 13, wherein the curved flange has a front lip on an outermost portion of the curved flange, and a radius of curvature of the front lip is from 0.015 to 0.025 inches.

18. The bottle according to claim 13, wherein the curved flange extends from the base member such that an angle of elevation between the curved flange and a horizontal surface of the base member is from 80 to 90 degrees, the curved flange has a radius of curvature of from 0.025 to 0.035 inches, the curved flange has a front lip on an outermost portion of the curved flange, and a radius of curvature of the front lip is from 0.015 to 0.025 inches.

19. The bottle according to claim 13, wherein the flip-top member includes an outer rim on a perimeter of the flip-top member, the base member includes a recessed rim on a perimeter of the base member, and a portion of the outer rim contacts the base member when the closure is in a closed position.

20. The bottle according to claim 13, wherein the opening of the base member is circular, the curved flange forms an arc around the opening of the base member, and an angle of the arc is from 120 to 180 degrees.

21. The bottle according to claim 13, wherein the body includes a threaded portion, the closure includes a threaded portion, and the threaded portion of the closure is configured to detachably engage the threaded portion of the body.

22. The bottle according to claim 13, wherein the opening of the base member includes an elongated opening from a front to a rear portion of the closure.

23. A closure, comprising:

a flip-top member including an elongated flange;

a base member including a curved flange extending from the base member, the curved flange having a radius of curvature of from 0.025 to 0.035 inches; and a hinge configured to connect the flip-top member and the base member, wherein the base member has an opening therein, a portion of the elongated member is configured to reside within the opening when the closure is in a closed position, and the curved flange has a front lip having a radius of curvature from 0.015 to 0.025 inches on an outermost portion of the curved flange.

* * * * *